US009046317B2

(12) United States Patent
McPherson

(10) Patent No.: US 9,046,317 B2
(45) Date of Patent: Jun. 2, 2015

(54) ARCHERY BOW CABLE DAMPER

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/665,014

(22) Filed: Oct. 31, 2012

(65) Prior Publication Data

US 2014/0116408 A1 May 1, 2014

(51) Int. Cl.
*F41B 5/20* (2006.01)
*F41B 5/10* (2006.01)
*F41B 5/14* (2006.01)

(52) U.S. Cl.
CPC *F41B 5/1426* (2013.01); *F41B 5/10* (2013.01)

(58) Field of Classification Search
CPC ..... F41B 5/1426; F41B 5/1407; F41B 5/10
USPC ..... 124/23.1, 25.6, 86, 88, 89
See application file for complete search history.

(56) References Cited

U.S. PATENT DOCUMENTS

| | | | | |
|---|---|---|---|---|
| 1,044,412 | A | | 11/1912 | Newton |
| 1,211,480 | A | | 1/1917 | Newton |
| 1,232,000 | A | | 7/1917 | Chase |
| 1,354,469 | A | | 10/1920 | Daniele |
| 1,918,652 | A | | 7/1933 | Marbach |
| 3,059,370 | A | | 10/1962 | Moore |
| 3,658,157 | A | | 4/1972 | Lee |
| 3,757,761 | A | | 9/1973 | Izuta |
| 4,054,121 | A | | 10/1977 | Hoyt, Jr. |
| 4,061,125 | A | * | 12/1977 | Trotter ..... 124/23.1 |
| 4,203,412 | A | | 5/1980 | Rickard |
| 4,207,858 | A | | 6/1980 | Blackstone |
| 4,377,152 | A | * | 3/1983 | Saunders ..... 124/88 |
| 4,440,143 | A | * | 4/1984 | Nishioka ..... 124/25.6 |
| 4,452,222 | A | * | 6/1984 | Quartino et al. ..... 124/23.1 |
| 4,461,267 | A | | 7/1984 | Simonds et al. |
| 4,628,892 | A | | 12/1986 | Windedahl et al. |
| 4,819,611 | A | | 4/1989 | Sappington |
| 4,834,061 | A | * | 5/1989 | Chattin ..... 124/86 |
| 4,903,678 | A | * | 2/1990 | Walker ..... 124/90 |
| 4,917,070 | A | * | 4/1990 | Townsend ..... 124/23.1 |
| 4,919,108 | A | * | 4/1990 | Larson ..... 124/88 |

(Continued)

FOREIGN PATENT DOCUMENTS

| | | |
|---|---|---|
| WO | 01/59392 | 8/2001 |
| WO | 01/59393 | 8/2001 |

OTHER PUBLICATIONS

U.S. Appl. No. 61/101,562, filed Sep. 30, 2008; Inventor: Mathew A. McPherson.

(Continued)

*Primary Examiner* — Melba Bumgarner
*Assistant Examiner* — Alexander Niconovich
(74) *Attorney, Agent, or Firm* — Vidas, Arrett & Steinkraus

(57) ABSTRACT

Impeding the forward movement of harness cables returning to rest position at the brace condition, the present invention reduces noise and vibration produced from shooting arrows. Forward movement of harness cables resulting from a bow returning from drawn to brace condition is impeded by an appropriately positioned energy absorber. The energy absorber is secured to a body projecting from the riser towards the harness cables.

22 Claims, 5 Drawing Sheets

(56) References Cited

U.S. PATENT DOCUMENTS

| | | | | |
|---|---|---|---|---|
| 5,002,035 | A | 3/1991 | Brooks | |
| 5,010,622 | A | 4/1991 | Morita | |
| 5,016,602 | A | 5/1991 | Mizek | |
| 5,178,122 | A * | 1/1993 | Simonds | 124/25.6 |
| 5,320,085 | A | 6/1994 | Hanneman | |
| 5,323,756 | A | 6/1994 | Rabska | |
| 5,368,006 | A | 11/1994 | McPherson | |
| 5,392,757 | A * | 2/1995 | Head et al. | 124/86 |
| 5,415,149 | A | 5/1995 | Derus et al. | |
| 5,452,704 | A * | 9/1995 | Winebarger | 124/92 |
| 5,531,211 | A | 7/1996 | Wilfong, Jr. | |
| 5,535,731 | A | 7/1996 | Webster | |
| 5,553,600 | A * | 9/1996 | Miller | 124/86 |
| 5,649,527 | A | 7/1997 | Olsen et al. | |
| 5,718,213 | A * | 2/1998 | Gallops et al. | 124/25.6 |
| 5,720,269 | A * | 2/1998 | Saunders | 124/86 |
| 5,722,385 | A * | 3/1998 | Bunk | 124/86 |
| 5,791,324 | A | 8/1998 | Johnson | |
| D412,021 | S | 7/1999 | Gray | |
| 5,975,070 | A | 11/1999 | Sands | |
| 5,983,880 | A * | 11/1999 | Saunders | 124/25.6 |
| 5,992,403 | A | 11/1999 | Slates | |
| 6,092,516 | A * | 7/2000 | Martin et al. | 124/88 |
| 6,098,607 | A * | 8/2000 | Strother | 124/25.6 |
| 6,152,124 | A * | 11/2000 | Gallops, Jr. | 124/25.6 |
| 6,178,958 | B1 * | 1/2001 | Gallops, Jr. | 124/25.6 |
| 6,257,220 | B1 | 7/2001 | McPherson et al. | |
| 6,298,842 | B1 | 10/2001 | Sims | |
| 6,382,201 | B1 | 5/2002 | McPherson et al. | |
| 6,425,385 | B1 | 7/2002 | Gallops, Jr. | |
| 6,443,139 | B1 | 9/2002 | McPherson | |
| 6,532,945 | B1 * | 3/2003 | Chattin | 124/25.6 |
| 6,550,467 | B2 * | 4/2003 | Gallops, Jr. | 124/25.6 |
| 6,634,348 | B2 * | 10/2003 | Gallops, Jr. | 124/25.6 |
| 6,655,371 | B2 | 12/2003 | Gallops, Jr. | |
| 6,681,753 | B2 | 1/2004 | Afshari | |
| 6,681,754 | B1 | 1/2004 | Angeloni | |
| 6,681,755 | B2 | 1/2004 | Pujos | |
| 6,708,684 | B2 | 3/2004 | Chattin | |
| 6,715,479 | B1 * | 4/2004 | Bunk | 124/25.6 |
| 6,722,354 | B1 | 4/2004 | Land | |
| 6,745,756 | B1 | 6/2004 | Achkar | |
| 6,745,757 | B2 | 6/2004 | Sims | |
| 6,802,307 | B2 | 10/2004 | Leven | |
| 6,871,643 | B2 * | 3/2005 | Cooper et al. | 124/25.6 |
| 6,889,679 | B2 * | 5/2005 | Chattin | 124/25.6 |
| 6,904,900 | B2 * | 6/2005 | Gallops, Jr. | 124/25.6 |
| 6,966,314 | B2 * | 11/2005 | McPherson | 124/89 |
| 7,721,724 | B2 | 5/2010 | Goade | |
| 7,753,044 | B2 | 7/2010 | Goade | |
| 7,793,646 | B2 * | 9/2010 | Cooper et al. | 124/89 |
| 7,954,481 | B2 * | 6/2011 | Barnard | 124/88 |
| 8,020,544 | B2 | 9/2011 | McPherson et al. | |
| RE42,842 | E * | 10/2011 | McPherson | 124/89 |
| 8,028,685 | B2 * | 10/2011 | Clark | 124/25.6 |
| 8,176,906 | B2 * | 5/2012 | Simo et al. | 124/25.6 |
| 8,272,374 | B2 * | 9/2012 | Cooper | 124/88 |
| 8,276,576 | B1 * | 10/2012 | Kuhn | 124/89 |
| 8,402,960 | B2 * | 3/2013 | McPherson | 124/88 |
| 8,408,195 | B2 * | 4/2013 | McPherson | 124/86 |
| 8,522,767 | B1 * | 9/2013 | Kuhn | 124/89 |
| 2003/0136392 | A1 * | 7/2003 | McPherson | 124/25.6 |
| 2006/0027820 | A1 | 2/2006 | Cao | |
| 2006/0180135 | A1 * | 8/2006 | Andrews | 124/89 |
| 2008/0127961 | A1 | 6/2008 | McPherson | |
| 2008/0264400 | A1 * | 10/2008 | Wright | 124/89 |
| 2009/0071458 | A1 * | 3/2009 | Gordon et al. | 124/25.6 |
| 2009/0133683 | A1 * | 5/2009 | Wright | 124/89 |
| 2010/0132685 | A1 | 6/2010 | De Sousa | |
| 2010/0224178 | A1 * | 9/2010 | McPherson | 124/25.6 |
| 2010/0319670 | A1 * | 12/2010 | Sims et al. | 124/89 |
| 2011/0011385 | A1 * | 1/2011 | Grace et al. | 124/25.6 |
| 2011/0073090 | A1 * | 3/2011 | McPherson | 124/25.6 |
| 2011/0192385 | A1 * | 8/2011 | Clark | 124/25.6 |
| 2011/0247602 | A1 * | 10/2011 | McPherson | 124/25.6 |
| 2012/0042861 | A1 * | 2/2012 | Anselmo | 124/25.6 |
| 2012/0042864 | A1 | 2/2012 | McPherson | |

OTHER PUBLICATIONS

U.S. Appl. No. 61/157,852, filed Mar. 5, 2009; Inventor: Mathew A. McPherson.

Bowtech Archery Website; Accessed on Jun. 7, 2012; http://www.bowtecharchery.com/#/technologyBreakdown?r=products_technology&i=6.

"Dealer-Only Jennings Line Gets New Damping System, Uniqur Camo", Arrowtrade, Jan. 2002 Edition, pp. 50-52.

* cited by examiner

ARCHERY BOW CABLE DAMPER

BACKGROUND OF THE INVENTION

This invention relates to archery bows and more specifically to an archery bow cable damper accessory and/or archery bows comprising a cable damper accessory.

The release of an arrow from a bow creates noise and vibration. An arrow is typically launched from a bow by drawing the bowstring backwards, changing the bow from brace condition to drawn condition. The subsequent release of the bowstring propels the arrow forwards as the bow returns to brace condition. The bowstring, however, does not stop its forward movement when it reaches the brace position. It rather continues forward past the brace position, rebounds backwards past the brace position and then oscillates about the brace the position before coming to rest at the brace condition. Attempts to reduce noise and vibration by suppressing bowstring oscillation are documented in patents that have issued for such devices. Bowstring stops, such as those disclosed in U.S. Pat. No. 4,061,125 and U.S. Patent Application No. 2010-0224178, are an example. Another bowstring damping concept is the bowstring suppressor system developed by Mathews, detailed in U.S. Pat. No. 6,966,314 and U.S. Reissue Pat. No. RE42842.

Focusing on the bowstring, previous inventions for suppressing noise and vibration neglect the harness cables present in compound bows. The prototypical compound bow comprises a riser disposed between a first limb and second limb attached to opposite ends of the riser. The bowstring extends between the first and second limb and has a plane of travel between the brace and drawn condition. In addition to the bowstring, compound bows possess harness cables extending between the first and second limb situated in planes off set from the plane of the bowstring travel as to avoid interfering with the release of an arrow. Drawing the bowstring backwards along its plane of travel transitions the bow from the brace to drawn condition by the action of at least one harness cable, typically referred to as a power cable. As the bow string is drawn, the power cable is taken up by at least one pulley or cam at a limb tip causing the limbs to flex. In some bows, often referred to as dual cam bows, the harness cables include a second power cable typically taken up by at least one pulley or cam at the limb tip opposite that of the first power cable. The combined action of the bowstring and two power cables flexes the limbs. In addition to a power cable, the harness cables may include a control cable that controls let out of the bow string. Control cables may be continuous with the bowstring, as typically seen in single cam bows. In combination or the alternative, as typically seen in one-and-half cam bows, control cables may be discontinuous with the bowstring. Regardless of the specific arrangement of the harness cables, displacing the bowstring rearwards during the draw cycle flexes the limbs and typically moves the harness cables rearward. Launching an arrow by releasing the drawn bowstring causes the harness cables to move forward and oscillate about the brace position as the bow returns to its brace condition, thereby inducing vibrations in the harness cables. Accordingly a need exits for a device to suppress vibration of the harness cables following the launch of an arrow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

Embodiments of the present invention may include an archery bow having a brace condition and a drawn condition, comprising: a riser and a first and second limb supported by the riser; a bowstring and at least one harness cable extending between the first limb and second; and a cable damper having an energy absorber secured to the body opposite the riser. The energy absorber is positioned to damp vibrations of the harness cable resulting from the bow returning from drawn condition to brace condition and has a greater distance of separation from the harness cable in the drawn condition than the brace condition.

Impeding forward and/or oscillatory movement of harness cables returning to their rest position at the brace condition, the present invention reduces noise and/or vibration produced from shooting arrows. Forward and/or oscillatory movement of harness cables resulting from a bow returning from drawn to brace condition is impeded by an energy absorbing component appropriately positioned to come into contact with the harness cable as the bow returns to the brace condition.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
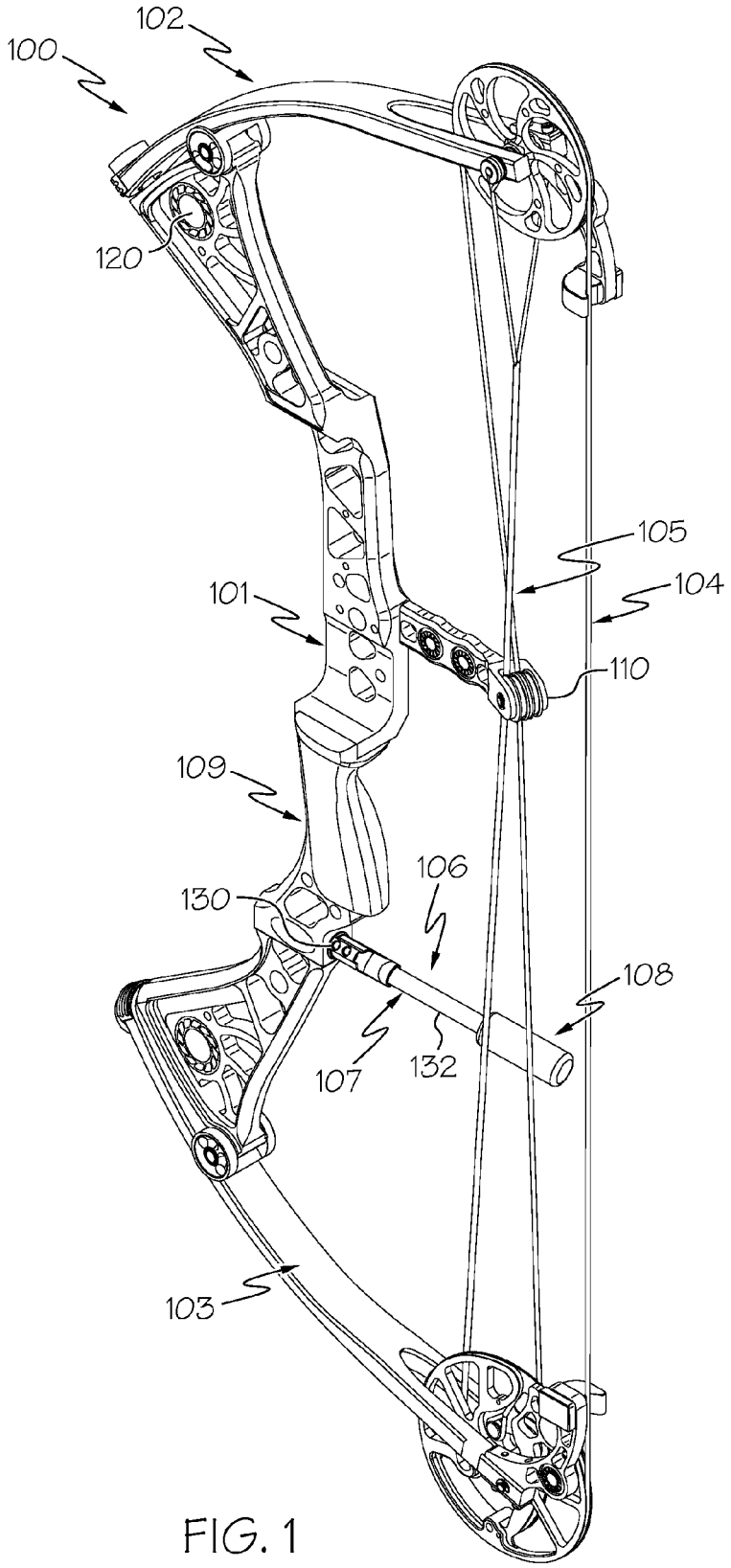
FIG. 1 depicts an embodiment of an archery bow having a brace condition and drawn condition, having an embodiment of a cable damper.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 depicts an archery bow 100 having a brace condition and drawn condition equipped with one possible embodiment of a cable damper 106. Bow 100 comprises a riser 101 having attached at opposite ends a first limb 102 and a second limb 103. Bowstring 104 extends between first limb 102 and second limb 103 and will move in a plane travel between the brace and drawn condition. Harness cables 105 also extend between the first and second limbs 102, 103 but are held offset from the plane of the bowstring travel by cable guard 110, to prevent interference with the flight path of an arrow during launch. Bow 100 further includes an embodiment of a cable damper 106 comprising a body 107 projecting from riser 101 towards harness cables 105. Secured to the end of body 107 opposite riser 101 is energy absorber 108 positioned to impede movement of at least one harness cable 105, resulting from bow 100 returning from the drawn to brace condition. In some embodiments, a cable damper 106 is arranged to impede movement of multiple harness cables 105.

In some embodiments, the cable damper 106, as shown in FIG. 1, is attached to riser 101 below grip 109. Cable damper 106 may be secured to riser 101 at other locations. For example, in some embodiments, cable damper 106 is attached to the riser at a position enabling energy absorber 108 to engage harness cables 105 approximately midway between first limb 102 and second limb 103. Cable damper 106 may also be attached to riser 101 at a position such that energy absorber 108 engages harness cables 105 above the midpoint of its span between limbs 102 and 103. Cable damper 106, alternatively, may be positioned such that energy absorber 108 engages harness cables 105 approximately midway between a limb (e.g. 103) and a cable guard 110.

Regardless of the positioning of energy absorber 108 along the span of harness cables 105, it is desirably positioned to engage harness cables 105 as to impede oscillatory movement of harness cables 105 occurring when bow 100 returns to brace condition, thereby dampening vibrations.

In some embodiments, the body 107 of the cable damper 106 comprises a bracket 130. In some embodiments, the body 107 further comprises a rod 132. The rod 132 can attach between the bracket 130 and the energy absorber 108. In some embodiments, a mounting stud can be attached to the riser 101, and the bracket 130 engages the mounting stud, for example by receiving the mounting stud in a cavity in the bracket 130. In some embodiments, a fastener that attaches the bracket 130 to the riser 101 (such as a mounting stud) defines a first axis, and an axis of the rod 132 is offset from the first axis. In some embodiments, a cavity in the bracket 130 to receive a fastener is offset from a second cavity in the bracket 130, which receives the rod 132. Such offset cavities provide adjustability that allows a given embodiment of a cable damper 106 to be configured for use with different bows.

Figure 2A:
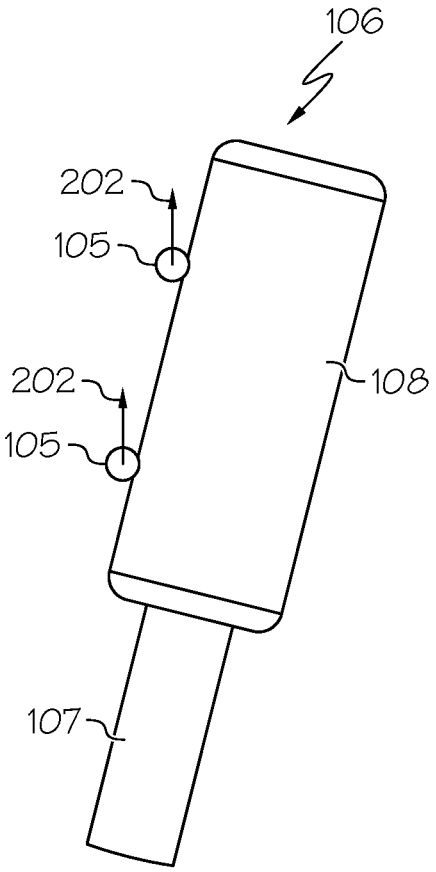
FIG. 2*a* depicts an embodiment in which harness cables contact an embodiment of the cable damper in brace condition.
Figure 2B:
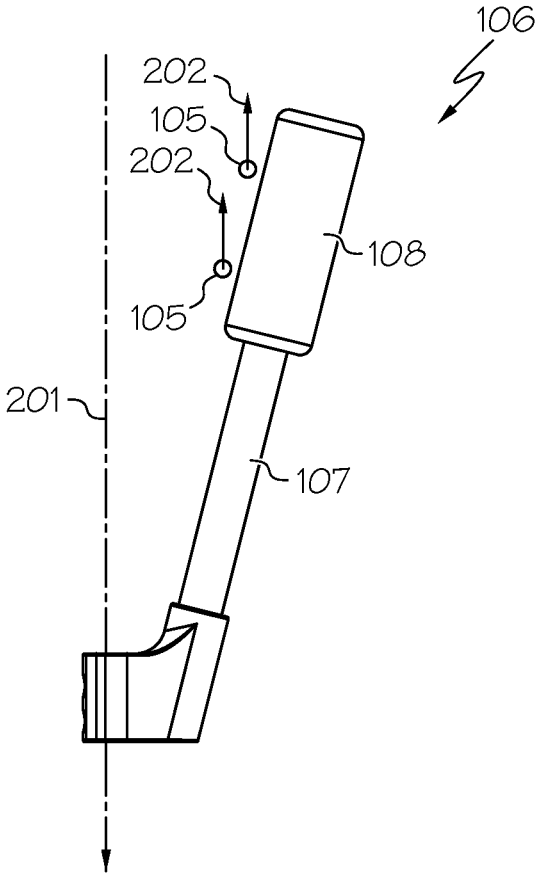
FIG. 2*b* depicts an embodiment in which harness cables are in proximity to an embodiment of the cable damper in brace condition.

In some embodiments, the cable damper 106 is positioned to impede forward movement (e.g. movement toward the riser 101) of one or more harness cables 105. As shown in FIG. 2*a*, harness cable(s) 105 may be in contact with energy absorber 108 when bow 100 is in the brace condition. Alternatively, energy absorber 108 may be positioned in close proximity to harness cables 105, as shown in FIG. 2*b*, when bow 100 is in the brace condition, such that damper 106 will impede forward and/or oscillatory movement of the harness cables 105 resulting from bow 100 retuning from drawn condition to brace condition by the harness cables 105 contacting the energy absorber 108. Drawing bowstring 104 backwards along its travel plane 201 (see FIG. 2*b*) between the brace and drawn condition, places the bow 100 in the drawn condition. During draw, the harness cable(s) 105 will move. In some bow embodiments, the harness cable(s) 105 move away from energy absorber 108 in a rearward direction 202 (e.g. away from riser). The distance, accordingly, between energy absorber 108 and harness cables 105 can be greater in the drawn condition than brace condition. Releasing bowstring 104 causes forward and/or oscillatory movement of harness cables 105 as bow 100 to returns to the brace condition. Harness cables 105 contact energy absorber 108 impeding movement of harness cables 105 resulting from bow 100 returning to brace condition. Contacting energy absorber 108 causes the residual energy in the harness cable(s) 105 to be absorbed by energy absorber 108. The absorption of energy provided by the cable damper 106 reduces further movement and/or vibration within harness cables 105.

Energy absorber 108 is desirably configured to receive and dampen residual energy from the harness cables 105 when impeding the motion of harness cables 105. All or a portion of energy absorber 108 can be made from a dampening material such as a rubber and/or a rubber compound, an elastomer such as a thermoplastic elastomer, a polyurethane, a styrene or any other suitable resilient material, or various combinations thereof. The portions of energy absorber 108 constructed from a dampening material may include at least the area(s) of contact with harness cable(s) 105. The energy absorber 108 can be cast, injection molded and/or formed using any other suitable method.

Figure 3:
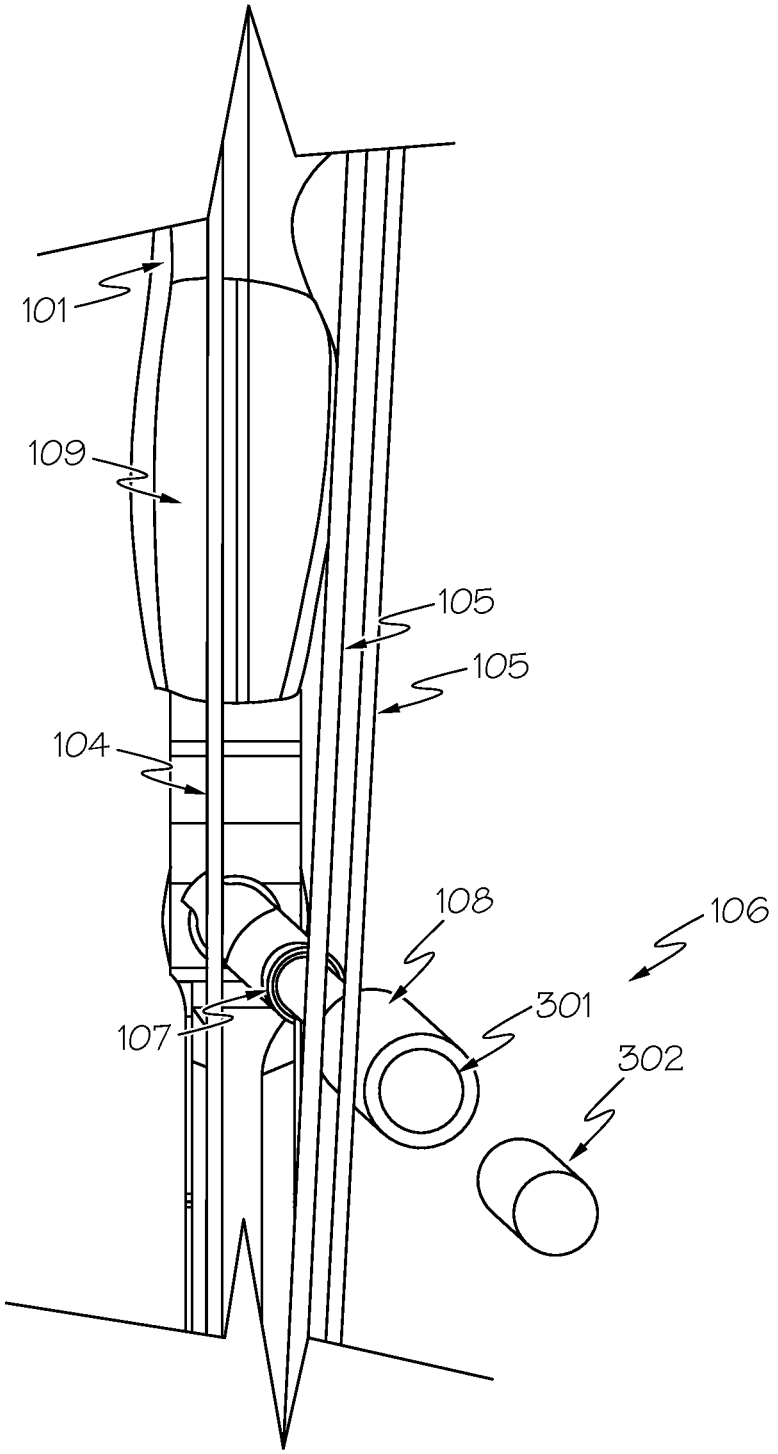
FIG. 3 depicts an embodiment of a cable damper having a cavity within the energy absorber.

FIG. 3 shows an embodiment of a bow from a rearward direction, such as an archer's view of the bow. An aperture or cavity 301 may be included within energy absorber 108. A user may change the particular characteristics of the cable damper 106 by leaving cavity 301 empty or inserting one or a plurality of various inserts 302. Insert 302 and energy absorber 108 may differ in a variety of characteristics and physical parameters. For example, one may have a higher durometer than the other. In combination or the alternative, one may comprise a material having a greater capacity for dampening than the other. In some embodiments, a material of the insert 302 is softer than a material of the energy absorber 108. In some embodiments, a material of the insert 302 is harder than a material of the energy absorber 108.

Energy absorbed by energy absorber 108 may be absorbed, in whole or in part, through the deformation of insert 302. In combination or the alternative, energy absorber 108 may also absorb energy, either externally or internally, via the friction resistance of insert 302 and a portion of energy absorber 108, such as, but not limited to, the walls of cavity 301. The cable damper 106 also provides bracing for the harness cable(s) 105 and can transfer forces to another portion of the bow, such as the riser 101. In some embodiments, a bow 100 comprises a vibration dampener 120, for example as shown in FIG. 1, which may be disposed in the riser 101.

The embodiment shown in FIG. 3 has cavity 301 generally orthogonal to harness cables 105 and aligned with the central axis of energy absorber 108. In the alternative, cavity 301 be positioned eccentric to the central axis of energy absorber 108. The energy absorber 108 can have any suitable shape, and the cavity 301 can have any suitable orientation. In some embodiments, cavity 301 may be positioned at angle with respect harness cables 105. For example, cavity 301 may be aligned generally parallel to harness cables 105. Alternatively or in combination, cavity 301 may be aligned with the location of harness cables 105 at brace. It is also possible cavity 103 be position in front or behind harness cables 105 at brace. In some embodiments, an opening for the cavity 301 can be on a sidewall of the energy absorber 108. In some embodiments, an opening for the cavity 301 can be on a sidewall of the energy absorber 108 that the harness cable(s) 105 contact. In some embodiments, an opening for the cavity 301 can be on a sidewall of the energy absorber 108 opposite from a surface that the harness cable(s) 105 contact.

FIGS. 1 through 3 depict an embodiment of cable damper 106 applied to a one-cam compound bow 100. It should be recognized that embodiments of cable damper 106 may be utilized with any suitable bow, such as, but not limited to, twin cam, Bi-nary cam, dual sync cam, cam and ½, CPS and shoot thru systems. It should also be recognized that embodiments of cable damper 106 within the scope of disclosure may differ from the specific shapes and configurations illustrated herein. Accordingly, other shapes and configurations may be employed. In combination or the alternative, cable dampers may be positioned to impede movement of one or multiple harness cables returning to brace condition. In some embodiments, the energy absorber 108 is oriented at an angle to the bowstring travel plane 201 (see FIG. 2*b*).

Figure 4:
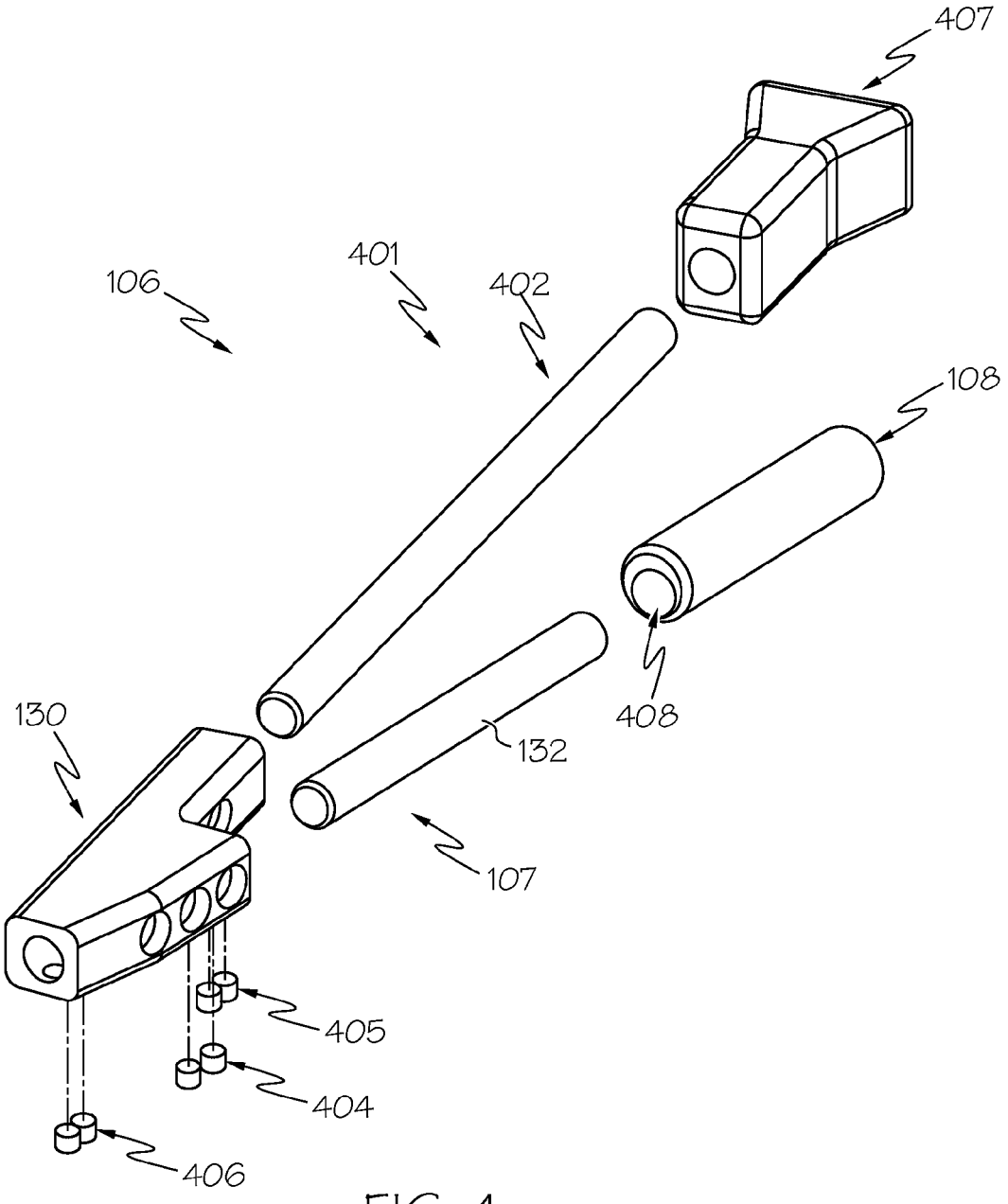
FIG. 4 depicts an embodiment of a cable damper comprising a bowstring stop.

As shown in FIG. 4, in some embodiments, a cable damper 106 further comprises a bowstring stop 401 arranged to contact the bowstring 104. In some embodiments, a bowstring stop 401 is similar to the bowstring stop disclosed in U.S. Patent Application No. 2010-0224178, the entire disclosure of which is hereby incorporated herein by reference. In some embodiments, a bowstring stop 401 comprises a body portion 402 attached to the cable damper body 107. In some embodiments, a bracket 130 is arranged to receive the bowstring stop body 402, for example having an additional cavity, and the bowstring stop body 402 attaches to the bracket 130 similarly to the cable damper rod 132 attachment. In the embodiment depicted in FIG. 4, body portion 402 and cable damper rod 132 are each secured to the bracket 130 with set screws 405 and 404 respectively. Likewise, the embodiment depicted in FIG. 4 utilizes fasteners 406 to secure the bracket 103 to riser 101, for example being arranged to engage a mounting stud.

In combination with or in the alternative to the structure depicted in FIG. 4, bowstring stop body portion 402 may be secured to body 107 at other locations and by others means readily recognizable to those skilled in the art. For example, body portion 402 may be welded or attached via an interface fit to body 107. In combination or the alternative, body portion 402 and body 107 may contain mating connectors.

The string stop 401 comprises a bumper 407 positioned in the plane of travel of bowstring 104 and arranged to impede movement of bowstring 104 occurring as the bow 100 returns to brace condition. Bumper 407 may be positioned a distance from of bowstring 104 when bow 100 is at brace condition to impede movement of bowstring 104 past and/or about its brace position. Alternatively, bumper 407 may be positioned to contract bowstring 104 at brace.

Any suitable configuration of a bowstring stop 401 may be utilized in the alternative to the specific bowstring stop 401 depicted in FIG. 4.

As demonstrated by the embodiment depicted in FIG. 4, energy absorber 108 may be connected to body 107 eccentrically. In the specific embodiment depicted in FIG. 4, energy absorber 108 includes an eccentric cavity 408 that is offset from the center of energy absorber 108 receiving the proximal end body 107. Eccentric cavity 408 permits the contact between energy absorber 108 and harness cables to be adjusted by simply rotating energy absorber 108 about body 107. In some embodiments body 107 may differ in a variety of characteristics and physical parameters from energy absorber 108 such that it changes the characteristics of energy absorber 108. In combination or the alternative, energy absorber 108 may also absorb energy via the friction resistance of body 107 and energy absorber 108. Accordingly, in some embodiments, body 107 may function similarly to insert 302.

Figure 5:
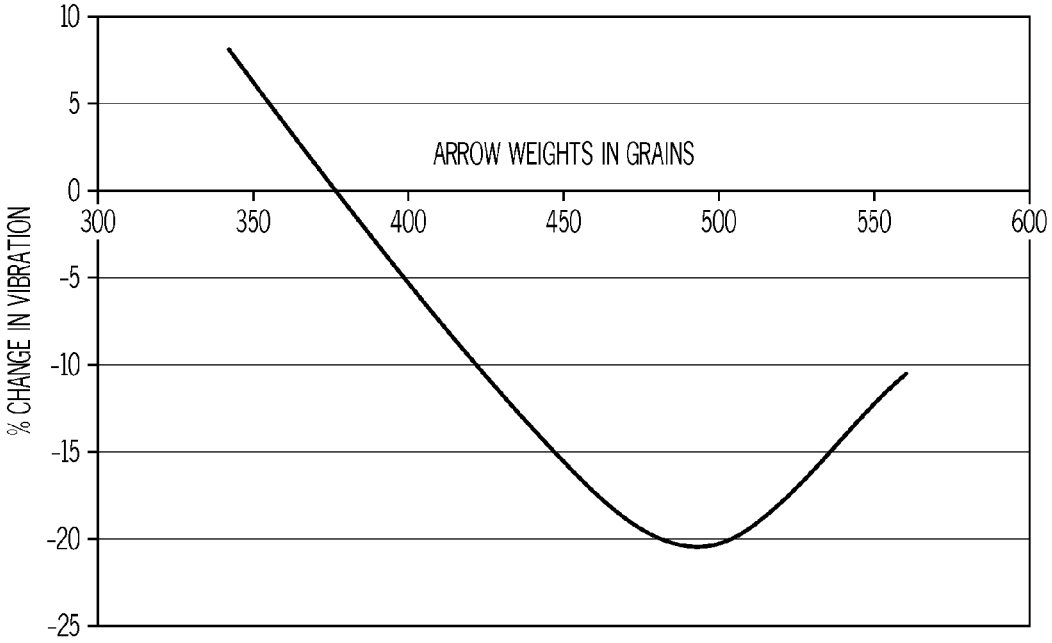
FIG. 5 presents a chart of the percent reduction in bow vibration as a function of arrow weight for a compound fitted within an embodiment of a cable damper.

As shown in FIG. 5, embodiments of the cable damper 106 can reduce bow vibration when fitted to a bow. The chart depicted in FIG. 5 plots the percent reduction in vibration at the grip of a hunting compound bow fitted with an embodiment of a cable damper, as a function of the mass weight in grains of the arrow shot from that bow. The arrow weights presented in the chart of FIG. 5 range from 340 grains to 570 grains. Arrows of each weight tested were shot a number of times from the test compound bow with and without the tested embodiment of a cable damper. For most hunting situations, it is recommended to use arrows having a mass weight of 375 grains or more. As can be seen from FIG. 5, the tested cable damper exhibited a positive effect at reducing bow grip vibrations for arrows of the commonly recommended hunting weight. For light to medium weight hunting arrows of 375 grains to 500 grains mass weight, the tested cable damper produced a reduction in bow vibration of up to 20 percent. For heavy hunting weight arrows of 500 grains to 570 grains mass weight, the tested cable damper produced a reduction in bow vibration tapering off to a 10 percent. As confirmed by field test, the test cable damper produced a noticeable reduction in bow vibrations for light to heavy hunting weight arrows. Other embodiments may produce even better results.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow having a brace condition and a drawn condition, the archery bow comprising:

a riser;

a first limb supported by the riser;

a second limb supported by the riser;

a bowstring extending between the first limb and second limb;

at least one harness cable extending between the first limb and second limb; and a cable damper attached to said riser, said cable damper comprising an energy absorber positioned to contact said at least one harness cable to dampen vibrations of said at least one harness cable resulting from the bow returning from drawn condition to brace condition and having a greater distance of separation from said at least one harness cable in the drawn condition than the brace condition.

2. The archery bow of claim 1 wherein, the energy absorber is in contact with the at least one harness cable when the bow is in the brace condition.

3. The archery bow of claim 1 wherein, the energy absorber does not contact the at least one harness cable when the bow is in the brace condition.

4. The archery bow of claim 1 wherein, the energy absorber comprises a dampening material.

5. The archery bow of claim 1 further comprising, a contact position on the energy absorber comprising a dampening material, wherein said contact position is located at a point on said energy absorber where said at least one harness cable contacts said energy absorber.

6. The archery bow of claim 1 further comprising, a cavity within the energy absorber.

7. The archery bow of claim 6 wherein, the cavity within the energy absorber is eccentric.

8. The archery bow of claim 6 further comprising, an insert within the cavity within the energy absorber.

9. The archery bow of claim 8 wherein, the insert and energy absorber have different durometers.

10. The archery bow of claim 1 further comprising, a cable guard secured to said riser and biasing said at least one harness cable in a lateral direction.

11. The archery bow of claim 10 wherein, the energy absorber engages the at least one harness cable approximately midway between the second limb and said cable guard.

12. The archery bow of claim 1 wherein said cable damper comprises a body secured to the riser and projecting from the riser towards the at least one harness cable, wherein the energy absorber is secured to the body opposite the riser.

13. The archery bow of claim 12 further comprising, a grip on the riser and wherein the body is secured to the riser below the grip.

14. The archery bow of claim 12, wherein the energy absorber is eccentric to the body.

15. The archery bow of claim 12 said body projecting from the riser further comprising, a string stop having a bumper positioned in a plane of travel of the bowstring to impede the movement of the bowstring.

16. The archery bow of claim 1 further comprising, a second harness cable extending between said first limb and said second limb, wherein said energy absorber is positioned to dampen vibrations of said at least one harness cable and said second harness cable resulting from the bow returning from drawn condition to brace condition.

17. The archery bow of claim 16, wherein said at least one harness cable comprises a power cable and said second harness cable comprises a second power cable.

18. The archery bow of claim 16, wherein said at least one harness cable comprises a power cable and said second harness cable comprises a control cable.

19. An archery bow having a brace condition and a drawn condition, the archery bow comprising:

a riser;

a first limb supported by the riser;

a second limb supported by the riser;

a bowstring extending between the first limb and second limb;

at least one harness cable extending between the first limb and second limb; and a cable guard secured to said riser and biasing said at least one harness cable in a lateral direction;

a body projecting from the riser towards the at least one harness cable; and an energy absorber secured to the body opposite the riser comprising a resilient material positioned on said energy absorber to contact the harness cable to damp vibrations of the harness cable resulting from the bow returning from drawn condition to brace condition.

20. The archery bow of claim 19 further comprising, at least one additional harness cable extending between said first limb and said second limb and wherein said resilient material is positioned on said energy absorber to damp vibrations of said at least one harness cable and said at least one additional harness cable resulting from the bow returning from drawn condition to brace condition.

21. The archery bow of claim 19 wherein said resilient material on said energy absorber engages the at least one harness cable approximately midway between the second limb and said cable guard.

22. The archery bow of claim 19 said body projecting from the riser further comprising, a string stop having a bumper positioned in a plane of travel of the bowstring to impede the forward movement of the bowstring.

* * * * *